US006189419B1

(12) United States Patent
Pijanowski

(10) Patent No.: US 6,189,419 B1
(45) Date of Patent: Feb. 20, 2001

(54) STEM STRUCTURE FOR RATCHET WRENCH

(76) Inventor: Joseph A. Pijanowski, 14351 Irving St., Brooksville, FL (US) 34609

( * ) Notice: Under 35 U.S.C. 154(b), the term of this patent shall be extended for 0 days.

(21) Appl. No.: 09/413,957

(22) Filed: Oct. 7, 1999

Related U.S. Application Data

(63) Continuation-in-part of application No. 08/951,625, filed on Oct. 16, 1997, now Pat. No. 5,967,002.

(51) Int. Cl.[7] ..... B25B 13/46

(52) U.S. Cl. ..... 81/57.39; 81/177.2; 81/177.85; 81/438; 81/451

(58) Field of Search ..... 81/57.39, 177.2, 81/177.85, 436, 438, 439, 451, 452

(56) References Cited

U.S. PATENT DOCUMENTS 4,096,896 * 6/1978 Engel ..... 81/438 X
5,186,083 * 2/1993 Hsiao ..... 81/177.85 X
5,351,586 * 10/1994 Habermehl et al. ..... 81/438
5,595,099 * 1/1997 Pusateri ..... 81/177.85

FOREIGN PATENT DOCUMENTS

403769 * 1/1934 (GB) ..... 81/439

* cited by examiner

*Primary Examiner*—James G. Smith

(57) ABSTRACT

Disclosed is a low profile air ratchet wrench with an improved rotor geometry for use in accepting a variety of stem sizes and shapes. Also disclosed are improved stem constructions. The stem constructions employ offset spring biased balls which allow for a better securement between the stem and rotor wall.

7 Claims, 10 Drawing Sheets

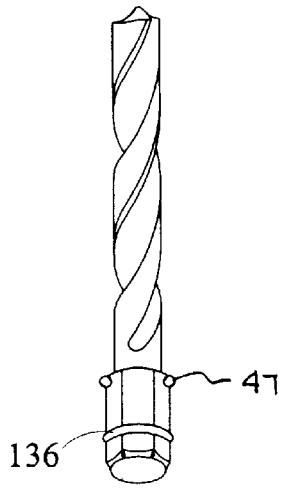
Figure 19
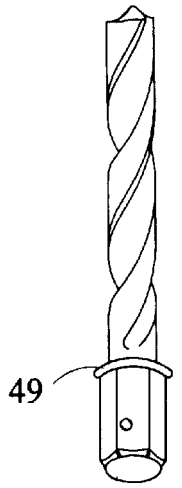
Figure 20
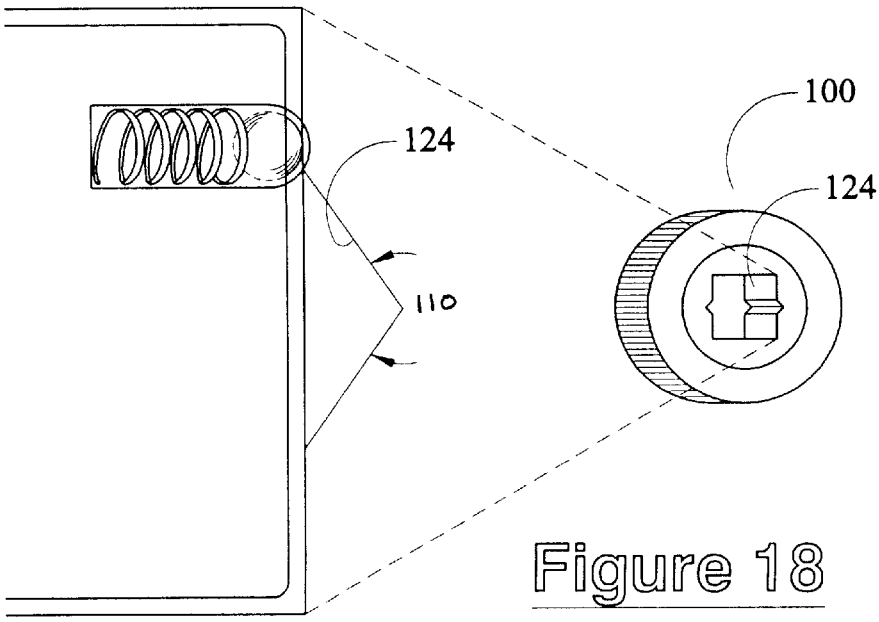
Figure 18
Figure 18A

STEM STRUCTURE FOR RATCHET WRENCH

RELATED APPLICATION DATA

This application is a continuation in part of application Ser. No. 08/951,625 filed on Oct. 16, 1997 and now U.S. Pat. No. 5,967,002 entitled "Rachet Wrench" and incorporated herein by reference.

BACKGROUND OF THE INVENTION

1. Field of the Invention

The present invention relates to a ratchet wrench and more particularly pertains to a ratchet wrench which can hold a variety of different sockets in one of two orientations.

2. Description of the Prior Art

The use of a ratchet wrenches is known in the prior art. More specifically, ratchets wrenches are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,174,176 to Krivec discloses a reversible ratchet wrench with an integrated dual pawl. This wrench includes a drive lug onto which a socket is attached. U.S. Pat. No. 4,993,288 to Anderson discloses a power driven ratchet wrench with an associated reciprocal pawl. U.S. Pat. No. 4,722,252 to Fulcher discloses a power driven wrench with a drive stud which accepts conventional sockets. U.S. Pat. No. 4,475,420 to Atkinson discloses a wrench apparatus with an engaging end designed to engage a conventional socket. U.S. Pat. No. 4,372,181 to Tinsley illustrates a compact power wrenching machine. U.S. Pat. No. 4,346,630 to Hanson discloses a ratchet wrench with a square item adapted to have a socket fitted thereon. U.S. Pat. No. 4,308,768 to Wagner discloses a ratchet lever with an interchangeable locking ring. U.S. Pat. No. 3,732,756 to Thomasian discloses a ratchet wrench with a socket facing each of its sides. U.S. Pat. No. 3,621,738 to Northcutt discloses a powered ratchet wrench with an associated socket wrench engaging stud. U.S. Pat. No. 3,529,498 to Northcutt discloses a power wrench with an associated stud. U.S. Pat. No. 3,145,594 to Peters discloses a ratchet wrench with a socket projection. U.S. Pat. No. 2,978,081 to Lundin discloses a drive assembly with an associated engaging end. Additionally, U.S. Design Pat. No. 289,135 to Doman and U.S. Design Pat. No. 269,938 to Izumisawa each disclose wrench designs.

Thus, the majority of prior art wrenches include socket engaging studs for cooperation with female socket tools. Additionally, the prior art wrenches employ reciprocal pawls.

In this respect, the ratchet wrench of the present invention substantially departs from the conventional concepts and designs of the prior art. Specifically, the ratchet wrench of the present invention includes a rotor and associated aperture which function to lockingly engage a male socket stem. Additionally, the socket can be driven in a clockwise sense by positioning the socket in a first rotor face, and in an anti-clockwise sense by inserting the socket in the opposing rotor face. Thus, the need for a two-sided pawl and a reverse handle with a spring mechanism is eliminated.

SUMMARY OF THE INVENTION

In view of the foregoing disadvantages inherent in the known types of ratchet wrenches now present in the prior art, the present invention provides an improved drive means for a ratchet wrench. As such, the general purpose of the present invention, which will be described subsequently in greater detail, is to enable clockwise or anti-clockwise socket rotation via a simplified socket drive.

To attain this, the present invention includes a rotor which is rotated by way of an oscillatory member. The oscillatory member, in turn, is driven by way of an air powered drive assembly. A star shaped aperture is centrally formed within the rotor. This aperture is adapted to accept the stems of a variety of sockets. Although the rotor only rotates in one sense, the sockets can be inserted into either of the opposing faces of the rotor. Thus, through changing the face into which the socket is inserted, either clockwise and anti-clockwise socket rotation can be achieved.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining the primary embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air driven ratchet wrench in either ¼", ⅜", ½" sizes or metric equivalents thereof. The wrench is adapted to accept a variety of sockets. The resulting ratchet/socket combination is of a super lower profile. The wrench includes a housing which is defined by a lower threaded extent and an upper bifurcated extent. The upper bifurcated extent has an aperture formed therethrough. Additionally, an arcuate oscillatory member is included which also has a centrally located aperture. A plurality of teeth are formed along an internal periphery of this aperture. The oscillatory member is secured within the upper bifurcated extent of the housing. Air powered drive means are located within the lower extent of the housing and are interconnected with the oscillatory member. The drive means functions to oscillate the oscillatory member. The wrench also includes a rotor. This rotor is defined by an upper bifurcated extent, a lower extent, first and second halves. A star shaped six pointed aperture is formed through a central extent of the rotor. An aperture is formed within the lower extent of the rotor. The rotor is adapted to be secured within aperture of the oscillatory member. A ratchet pawl is incorporated into the rotor. The pawl includes an engaging portion which is adapted to contact the internal periphery of the oscillatory member. Additionally, the ratchet pawl is secured within the bifurcated extent of the rotor. A ratchet pawl support pin and spring is angularly positioned within one side of the rotor and functions to support the engaging portion of the ratchet pawl. Additionally, a spring biased socket support bearing, to secure socket preferences, is incorporated into the rotor. This bearing is defined by an upper extent and a lower extent. The socket support is adapted to be positioned within the aperture within the lower extent of the rotor. The upper extent of the support is adapted to engage a socket positioned within the central aperture of the rotor.

It is another object of the present invention to provide a ratchet wrench that accepts male socket stems.

It is a further object of the present invention to provide a ratchet wrench that can accept a socket into either of two opposing rotor faces and thereby achieve either clockwise or anti-clockwise rotation.

An additional object of the invention is to provide a super low profile ratchet wrench for removing screws in automobile wheel opening moldings without having to spend time removing the corresponding tire.

An even further object of the present invention is to provide a ratchet wrench which is susceptible of a low cost of manufacture with regard to both materials and labor, and which accordingly is then susceptible of low prices of sale to the consuming public, thereby making such ratchet wrench economically available to the buying public.

Still another object of the present invention is to provide a ratchet wrench that, through the use of a star shaped aperture, can accept four and six sided socket stems. Additionally, it is an object of the present invention to enable the wrench to drive self taping sheet metal screws, nuts, or six sided screws.

Lastly, it is an object of the present invention to provide a ratchet wrench of simplified construction and decreased profile.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 18 is a view of the improved stem structure as positioned within a socket housing of the present invention.

FIG. 18A is an enlarged plan view of the improved stem structure positioned with socket installed in the rotor head and showing the offset ball and spring to keep the socket secure in any position.

FIG. 19 is a view of an improved stem structure for use in conjunction with a drill with button design to hold the drill in the head.

FIG. 20 is a view of an improved stem structure, with collar, for use in conjunction with an alternative drill structure securement.

Similar reference characters refer to similar parts throughout the several views of the drawings.

DESCRIPTION OF THE PREFERRED EMBODIMENT

The present invention relates to an air driven ratchet wrench. The wrench of the present invention includes a rotor which is rotated by way of an oscillatory member. The oscillatory member, in turn, is driven by way of an air powered drive assembly. A star shaped aperture is centrally formed within the rotor. This aperture is adapted to accept the stems of a variety of sockets. Although the rotor only rotates in one sense, the sockets can be inserted into either of the opposing faces of the rotor. Thus, through changing the face into which the socket is inserted, either clockwise and anti-clockwise socket rotation can be achieved. The various components of the present invention, and the manner in which they interrelate, will be described in greater detail hereinafter.

Figure 1:
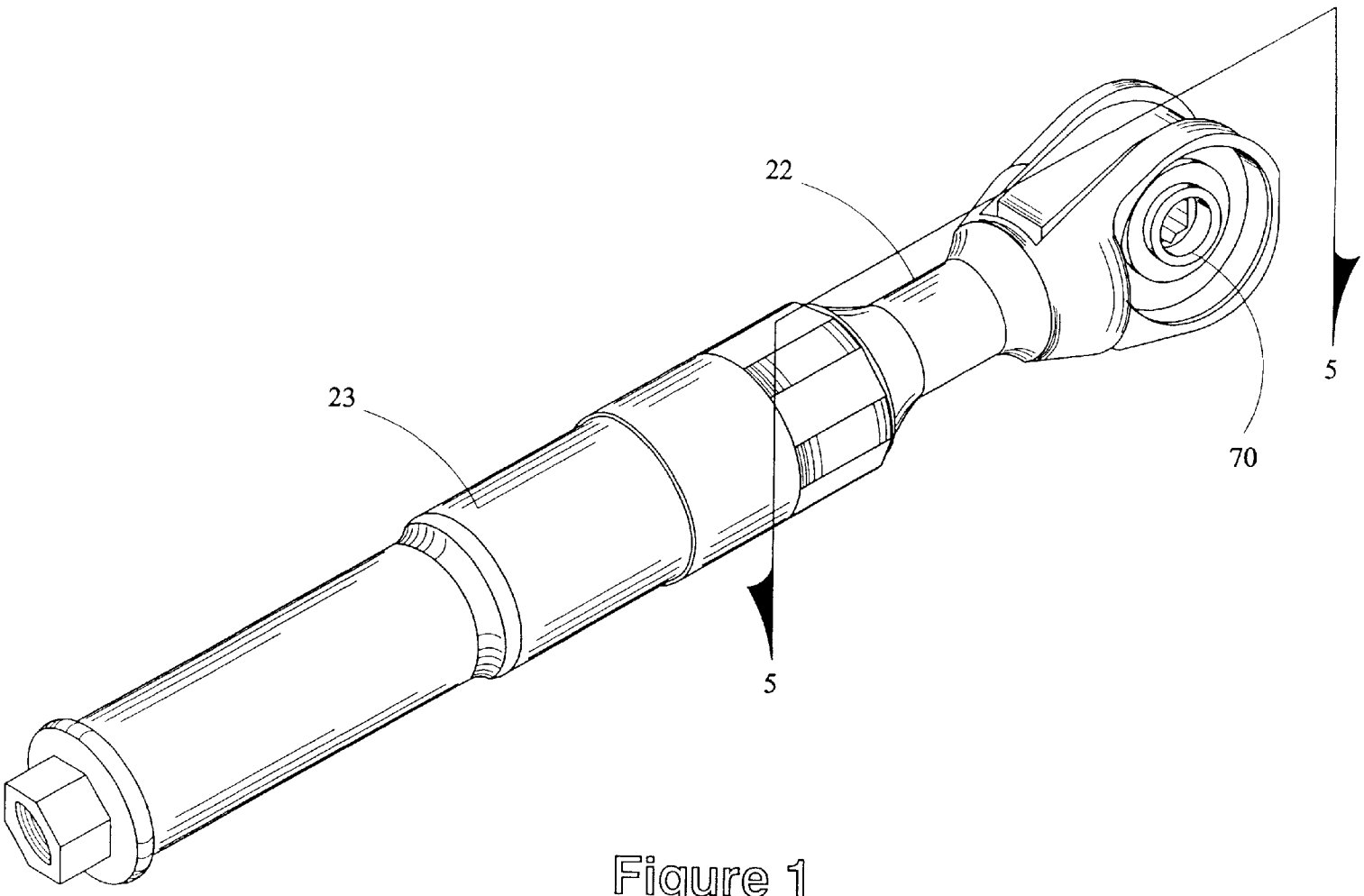
FIG. 1 a perspective view of the ratchet wrench of the present invention.

With reference to FIG. 1, an ratchet wrench 20 of the present invention is depicted. Although the wrench is being described as air powered, other motive forces can be used. The wrench 20 generally includes a housing portion 22 and a handle portion 23. The housing 22 includes a lower threaded extent 24 and an upper bifurcated extent 26. The bifurcated extent 26 is formed by an oblong aperture positioned within the housing portion 22. Additionally, the upper bifurcated extent 26 includes a centrally located aperture 28.

An arcuate oscillatory member 32 is specifically adapted to be secured within the bifurcated extent 26 of the housing 22. The oscillatory member 32 is defined by a centrally located aperture 34. Additionally, a plurality of teeth 36 are formed along the internal periphery of the aperture 34. The securement between member 32 and housing 22 is such that the oscillatory member 32 is permitted limited pivotally movement about the central axis of the bifurcated extent 28. Additionally, the oscillatory member 32 includes a concave recess formed at its lower extent. This recess allows the member to be interconnected with the driving means 38 of the wrench. This interconnection will be described in greater detail hereinafter.

Figure 2:
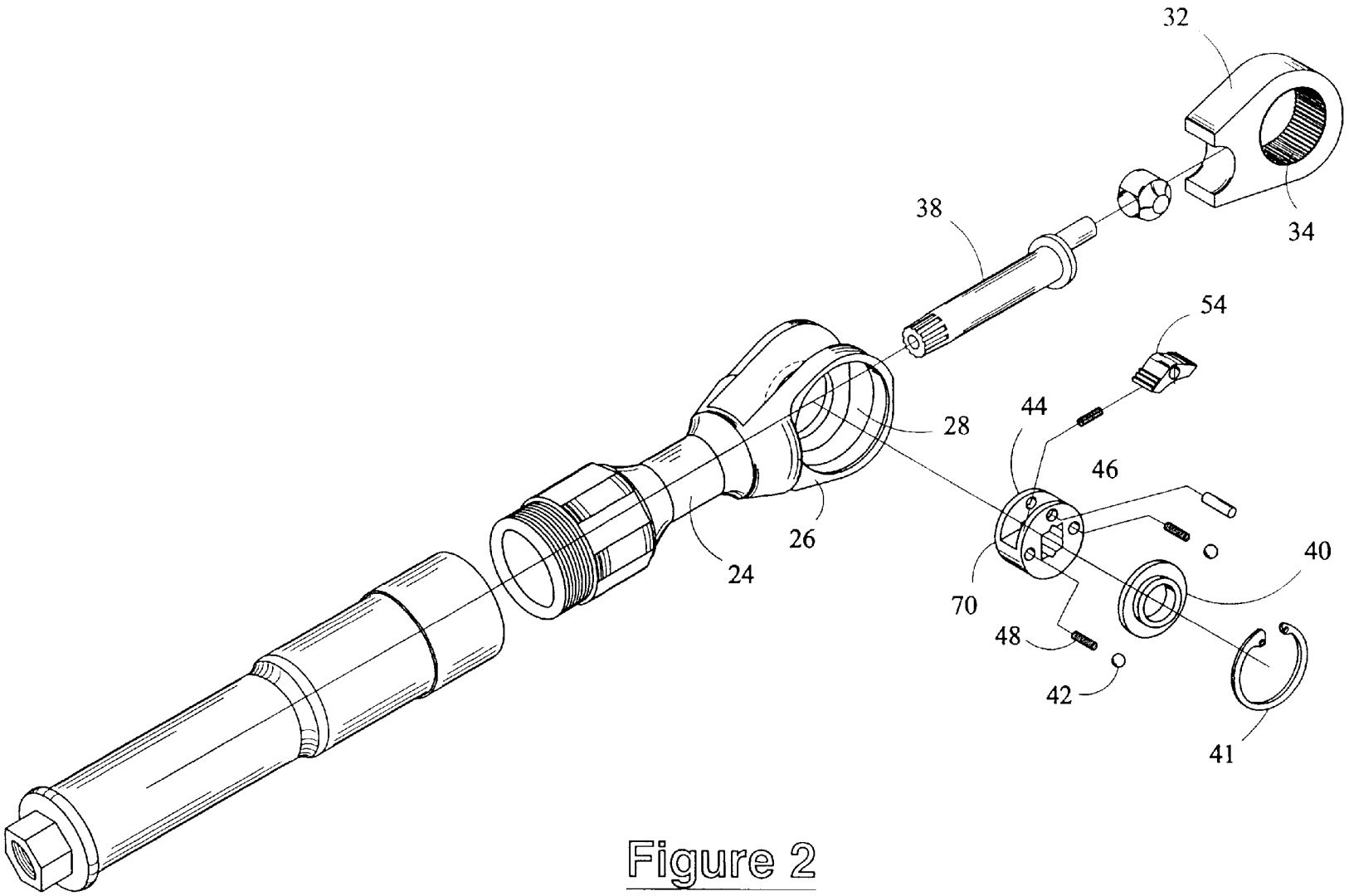
FIG. 2 is an exploded view of the ratchet wrench of the present invention.

As indicated hereinabove, the wrench 20 of the present invention is adapted to be driven by a source of pressurized air. Other driving means, however, are within the scope of the present invention. The air powered drive means 38 of the present invention is located within the lower extent 24 of the housing 22 and extends into the handle 23 of the wrench 20. More specifically, the drive means 38 includes a drive column which is positioned through the housing 22 and handle 23. The column is rotated by a gearing assembly (not shown). The gearing assembly, in turn, is powered by the source of compressed air. With reference to FIG. 2, a drive bushing is adapted to be positioned at the top of the drive column. The drive bushing is shaped to be received within the concave recess of the oscillatory member 32. Thus, rotation of the drive column results in the side to side movement of the drive bushing. The movement of the bushing, in turn, causes the angular oscillation of the member 32. In this manner, the drive means 38 is interconnected with the oscillatory member 32 and functions to oscillate the oscillatory member 32.

Figure 3:
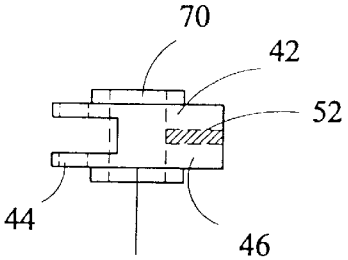
FIG. 3 is a side elevational view of the rotor of the present invention.
Figure 4:
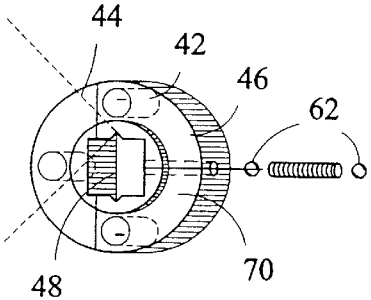
FIG. 4 is a plan view of the rotor of the present invention.

With reference to FIGS. 3 and 4, the rotor 42 of the present invention is depicted. The rotor 42 is secured within the aperture 34 of the oscillatory member 32. The securement is achieved by way of locking ring securement. One such assembly is depicted in FIG. 2. As illustrated, retaining washer 40 and lock ring 41 serve to hold rotor 42 once in the oscillatory housing 32. The securement also employs two ball bearings and springs 61 positioned within races on the internal surfaces of the bifurcated housing 26. The two ball bearings and springs in the rotor apply pressure on the washer to preclude the rotor from slipping. These ball bearings provide pressure between the rotor 42, retaining washer 40, lock ring 41 and housing 22 once the oscillatory member 32 is positioned within the housing 22. Such an arrangement prevents any slippage of the rotor within the housing 26 when member 32 is oscillating. The rotor 42, which is of a one piece construction, is defined by an upper bifurcated extent 44, a lower extent 46, and first and second halves. Additionally, a star shaped six pointed aperture 48 is formed through a central extent of the rotor 42. This aperture 48 is employed in securing socket stems 50 to the rotor 42.

In the preferred embodiment, as can be seen in FIG. 3, the height of the rotor 42 is about 0.625 inches. This would handle all sheet metal screws of the aperture therethrough to the rotor size. With a Phillips head socket inserted, there would be a height of between 1.0–1.125 inches. This would be the smallest tolerance ever utilized rendering it adapted for use in many tight applications.

Figure 7:
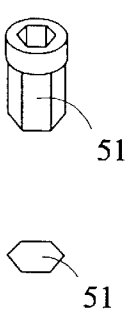
FIG. 7 is a view of a socket with a six sided stem for use within the wrench of the present invention.
Figure 6:
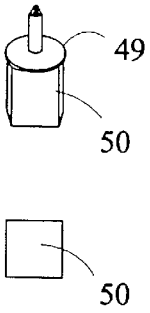
FIG. 6 is a view of a socket with a four sided stem for use within the wrench of the present invention.
Figure 9:
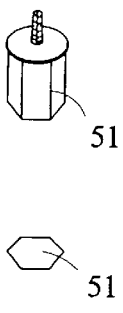
FIG. 9 is a view of a socket with a six sided stem.
Figure 17:
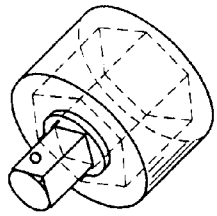
FIG. 17 is a view of an improved socket stem structure for use in tight areas.

With reference to FIGS. 6, 7 and 17, two such sockets and their associated stems 50 are depicted. The six pointed star shaped geometry of the aperture 48 enables it to accept either four or six sided stems 50 and 51 respectively. A four sided stem 50 is illustrated in FIG. 6. A six sided stem 51 is illustrated in FIG. 7. FIG. 9 illustrates a socket 52 and associated collar 49. The socket 52 is of a short ⅛" or ¾" drill height which is adapted to be used in a wheel opening for molding installations—unless for self tapping screws This socket 52, when used in conjunction with sockets 50 and 51, of various sizes, will speed time for a variety of mechanical installations. The sockets are secured with the rotor 42 aperture by way of a socket bearing 62. The bearing 62 is positioned within an aperture 52 formed within the lower extent 46 of the rotor 42. This bearing 62, and its position within the rotor 42, will be described in greater detail hereinafter.

The rotor 42 employs a ratchet pawl 54 which functions to contact the teeth 36 of the internal surface of the oscillatory member 32. The ratchet pawl 54, and its position within the rotor 42, is depicted in the cross section of FIG. 5. As illustrated, the ratchet pawl 54 is secured within the bifurcated extent 44 of the rotor 42. More specifically, a pin is employed in securing the pawl 54 to aligned apertures within the bifurcated extent 44 of rotor 42.

Figure 5:
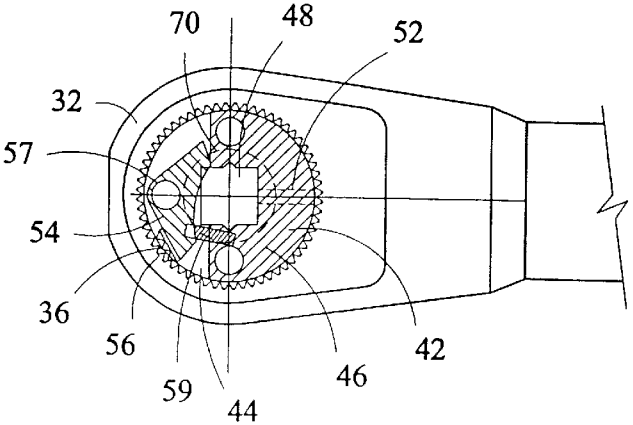
FIG. 5 is view taken along line 5—5 of FIG. 1.

With continuing reference to FIG. 5, the pawl 54 includes an engaging portion 56. This engaging portion 56 includes a series of teeth which are adapted to engage the teeth 36 on the internal periphery of the oscillatory member 32. Through this engagement, the oscillating angular movement of the member 32, pressure washer 40 and locking ring 41 serves to keep the rotor 42 from slipping. A ratchet pawl support pin 58 is angularly positioned within one side of the rotor 42. More specifically, the support pin 58 is angularly related to the longitudinal axis of the wrench 20. This pin 58 functions to support the engaging portion 56 of the ratchet pawl 54. Thus, the support pin 58 and spring ensure that the teeth of engaging portion 56 maintain positive contact with the teeth 36 of the oscillatory member 32 to run the rotor.

Figure 8:
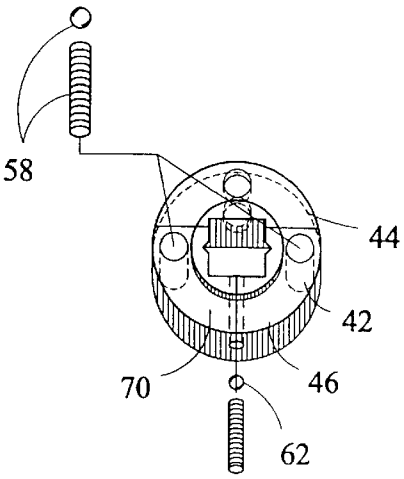
FIG. 8 is an exploded view of the rotor of the present invention.

A locking engagement between the rotor 42 and associated socket stem 51 is achieved by way of a socket support bearing 62. The bearing 62 is defined by an upper and lower extent. As illustrated in FIG. 8, the bearing 62 is adapted to be positioned within the aperture 52 within the lower extent 46 of the rotor 42. When so positioned, the upper extent of the support can engage socket stem 50 positioned within the central aperture 48 of the rotor 42. Socket stem 50 includes a collar 49. With socket stem 50, a locking engagement is achieved when collar 49 engages the periphery of aperture 48. The collar 49 prevents the socket from sliding into the aperture 48 when pressure is applied to the socket. In the preferred embodiment, the socket stems 50, 51 or 52 include surface indentations for lockingly engaging the bearing 62 to secure socket stems and prevent them from slipping out.

Thus, the rotor aperture 52 and associated support bearing 62 are adapted to accept a socket stem 50, 51, or 52 from either side of the rotor. The rotor, however, only rotates in one sense/direction. Specifically, the angular oscillatory movement of member 32 drives the rotor 42 only in one direction due to the positioning of pawl 54. Yet, because the socket stem can be positioned into either side of the rotor, both clockwise and anti-clockwise socket rotation can be achieved.

The rotor 42 also includes an associated rotor collar 70. This collar 70 enables the ratchet wrench to drive self tapping sheet metal screw. Additionally, this collar 70 would enable the wrench to drive nuts.

Figure 12:
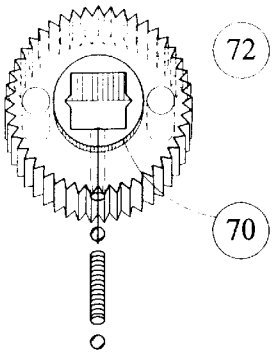
FIG. 12 is a view of an additional rotational member that can be employed in the second embodiment of the present invention.
Figure 11:
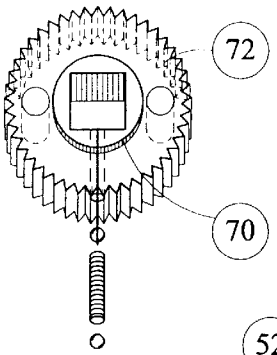
FIG. 11 is a view of the rotational member of the second embodiment.
Figure 10:
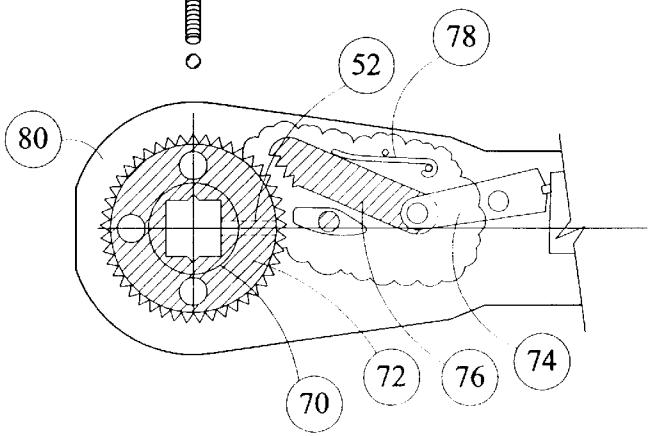
FIG. 10 is a view of the second embodiment of the present invention.

With reference to FIGS. 10–12, a second embodiment of the wrench is illustrated. This second embodiment utilizes a single geared rotational member 72 in place of oscillatory member 32 and rotor 42. The rotational member is positioned within the upper portion of housing 80. As with the primary embodiment, the upper portion of the housing 80 has an aperture formed therethrough. The rotational member 72 can employ either a centrally located square (FIG. 11) or star shaped (FIG. 12) aperture. As with the primary embodiment, these apertures are adapted to accept socket stems. The rotational member 72 is rotated via a two arm linkage: a base arm 74 and a pawl 76. The base arm 74 and pawl 76 are pivotally interconnected. The base arm 74 converts the rotational motion of the drive means into oscillatory motion. The base arm 74 transmits this oscillatory motion to the pawl 76. The pawl 76 has a series of teeth which are adapted to engage the geared outer periphery of the rotational member 72. Through this engagement, the pawl 76, as shown in FIG. 10, rotates the rotational member 72. Thus, the drive means is interconnected to the rotational member. A leaf spring 78 is positioned adjacent to the pawl 76. The leaf spring 78 functions to keep the pawl engaged with the periphery of the rotational member 72. As with the primary embodiment, the sockets can be rotated in differing directions by inserting the socket stems into either of the faces of the rotational member 72.

Improved Stem Structures

The present invention also relates to improved stem structures for use in conjunction with the wrench described hereinabove.

Figure 15:
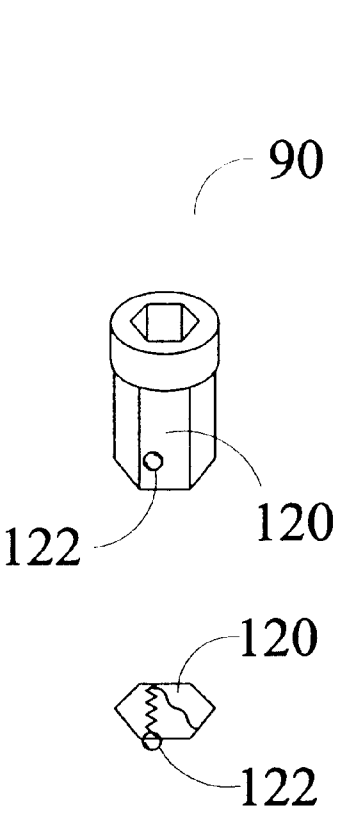
FIG. 15 is a view of an improved stem structure with offset ball/spring and rubber o-ring.
Figure 14:
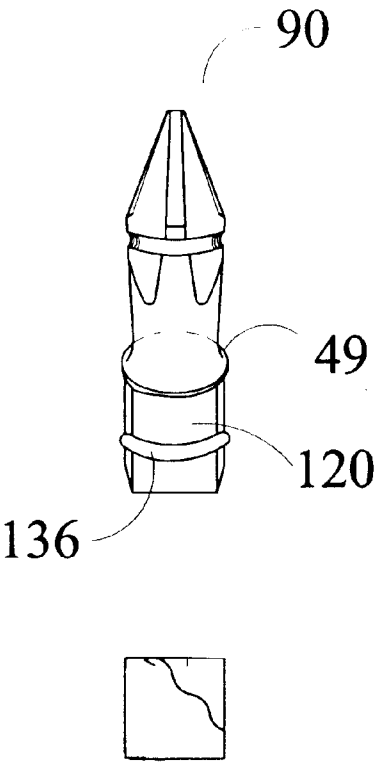
FIG. 14 is a view of an improved stem structure.
Figure 13:
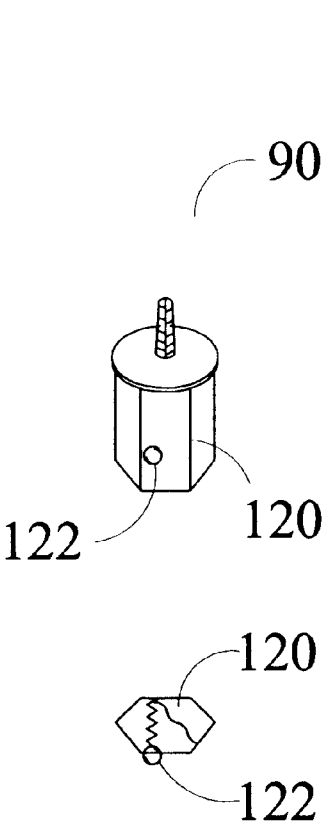
FIG. 13 is a view of an improved stem structure.

FIGS. 13–15 illustrate some of the improved stem structures 90 of the present invention. Each of these stem structures 90 is specifically adapted for use in conjunction with the rotor geometry 100 illustrated in FIG. 8, and more specifically in FIG. 18. Such rotor structure employs at least two faces which contain matching v-shaped recesses 110, as depicted in FIG. 18A. The specific embodiment illustrated in FIG. 18 has two opposing planar faces and two opposing faces which contain facing v-shaped recesses 110.

This rotor structure is thus dimensioned to receive a wide variety of stem sizes, both standard and metric. Additionally, the rotor structure is adapted to received a wide variety of socket stem geometries. This is achieved by employing the v-shaped recesses. Optimally, these v-shaped recesses form 120 degree angles. The allows for four or six sided stems to be inserted within the rotor. Other v-shaped recesses, of varying angles, can be employed to accommodate still yet other stem geometries. Consequently, each of the stem geometries depicted in FIGS. 13–15 can fit within the rotor structure of the present invention. As indicated, the rotor structure can also accept standard and metric sizes. For example, a rotor structure that accepts ¼ inch standard size stems will also readily accept 6 millimeter (mm) stems; sockets that accept ⅜ inch stems readily accept 10 mm stems; and sockets that accept M inch stems readily accept 13 mm stems.

Although any stem structure can be secured within the rotor structure of the present invention, it is preferred to use a stem employing a spring biased ball 122 as illustrated in FIGS. 13 and 15. More specifically, each of the stems illustrated in FIGS. 13 and 15 include a plurality of planar faces 120. With continuing reference to FIGS. 13 and 15, a spring biased ball 122 is positioned within a lower corner of one of the faces 120. The spring biased ball 122 positively engages an interior wall 124 of the rotor structure. This engagement, in turn, ensures that the stem will remain within the socket. Additionally, the off set position of the ball prevents its engagement with one of the v-shaped recesses 110, note FIG. 18*a*. By contrast, a centrally positioned ball might come to rest within one of the v-shaped channels, thereby reducing the locking effect. Furthermore, FIG. 14 illustrates an O-ring which can optionally perform the function of the ball 122.

Figure 16A:
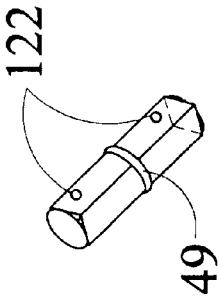
FIG. 16 is a male dual end for accepting two tools.
Figure 16:
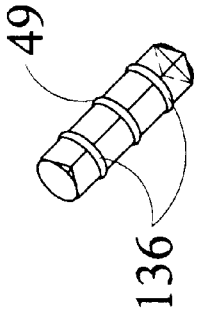

With reference now of FIG. 16, a steel collar 49 can be optionally positioned along the length of the stem to prevent it from traveling completely through the rotor face. FIG. 16 also depicts O-rings formed within associated grooves for use in both securing the stem within the rotor and a within a socket. Thus, the dual end stem structure can accept two tools.

Finally, FIGS. 19 and 20 illustrate drills which employ the stem structure of the present invention. Other drilling elements, however, can optionally be used in conjunction with the stem of the present invention.

Additionally, a female socket could also be used with the stem, note FIG. 17. The structure of FIG. 17 provides for extensions as needed. The socket of FIG. 17 is preferably of a super low profile for use in tight areas. Furthermore, the socket can accommodate various nut and bolt sizes.

Figure 23A:
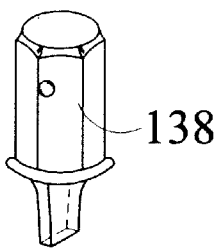
FIG. 23 is still yet another embodiment of the dual use stem structure.
Figure 23:
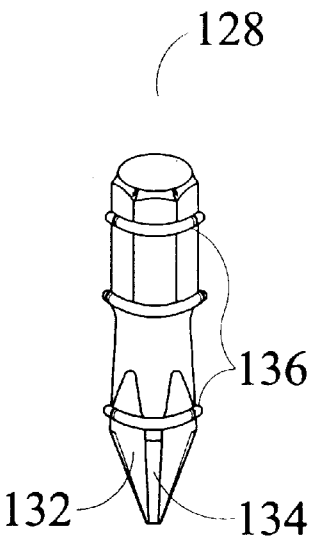
Figure 22:
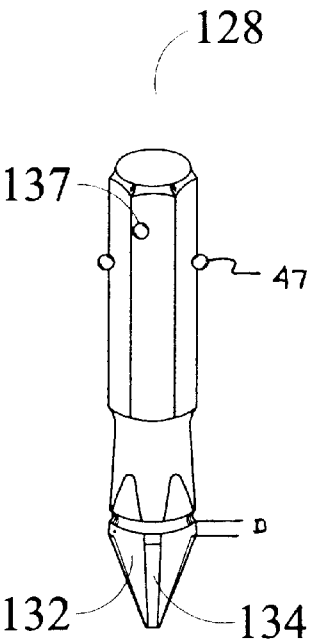
FIG. 22 is an additional embodiment of the dual use stem structure. This elongated stem structure allows a user to access screws which are buried in recessed areas.
Figure 21:
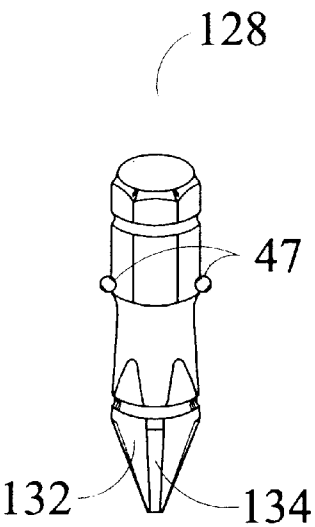
FIG. 21 is a view of a dual use stem structure with an included button and o-rings. The stem structure holds sockets without the need to change from the phillips head

With reference now to FIGS. 21–23, additional driving elements are illustrated. Again, the versatile, or dual use, driving elements 128 depicted in FIGS. 21–23 are for use in conjunction with a ratchet wrench. As illustrated, each of the stem sections have a plurality of planar faces. Additionally, an optional steel collar 49 can be positioned along the length of the stem to prevent insertion completely through the rotor face. FIG. 21 illustrates optional steel balls 47 which are welded to the stem shaft, also for preventing the driving element from passing through the rotor face. Such collar 49 enables a more positive fit between the rotor and stem.

FIGS. 21–23 also illustrate a driving element integral with one end of the stem section. In the preferred embodiment, the driving element takes the form of a phillips head screw driver 132. In this regard, the head employs four equally spaced fins 134. However, it is within the scope of the present invention to employ a flat head screw driver employing a single fin. Whichever driving element is employed, a straight, non tapered, section "D" (note FIG. 22) is included. This straight section enables the driving element to be secured within a female socket member 138 in a manner more fully described hereinafter. Thus, with the stem secured within the rotor of an associated wrench, a user can employ the driving element to remove screws of differing heights. The elongated stem structure depicted in FIG. 22 allows a user to access screws which are buried in recessed areas. FIGS. 21 and 23 each illustrate an elastomeric ring positioned at the upper extent of the stem. Each ring functions to provide a positive fit between the stem and rotor. Conversely, FIG. 22 illustrates an offset set spring biased ball which serves the same purpose as the elastomeric ring 136.

Figure 26:
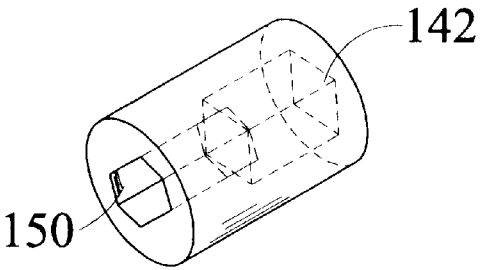
FIG. 26 shows a socket similar to that of FIG. 25 with a six sided recess instead of a four sided recess.
Figure 25:
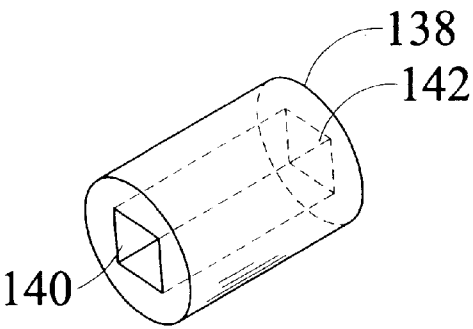
FIG. 25 is an illustration of a socket for use upon the dual use stem structure for accepting ¼ inch and 6 mm 4 or 6 sided stem structures
Figure 24:
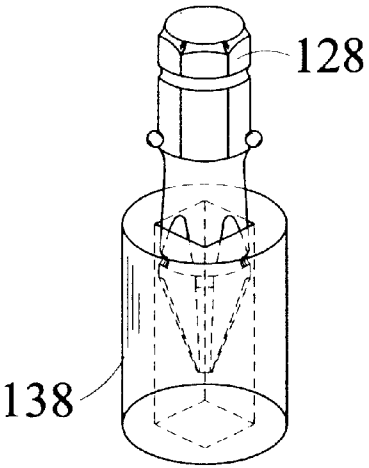
FIG. 24 is an illustration of the dual use stem structure with an attached socket or phillips tip secured by o-ring.

With continuing reference to FIGS. 21 and 23, an elastic o-ring 136 is positioned within a groove formed along the length of the driving element. This o-ring 136 functions in retaining a socket member 138. Such female socket member 138 has a first end with a recess formed therein 140. This recess 140 is adapted to accommodate ¼ inch sockets without changing the fastener type. Additionally, the recess 140 can be secured over nut or bolts of various sizes, or even additional tools employing the stem structures of the present invention. FIG. 26 illustrates a similar socket member utilizing a six sided recess 150 for securing stems of other geometries. Similarly, the socket has a second end with a recess formed 142 therein. This recess 142 is adapted to be removably positioned over the driving element 132 and its associated o-ring 136. Thus, the o-ring provides a tight fit between the socket and driving element. As indicated, the driving element over which the socket is positioned can be a phillips head or a conventional flat head screw driver.

Thus, with a stem portion fitted within a wrench, a user can readily employ the driving element to remove or secure conventional fasteners, such a screws. Furthermore, a user can quickly secure a female socket member over top of the driving element. The socket can be the ¼ inch sockets now in the market place. A positive interconnected between the driving element and socket is created by the presence of the o-ring.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An improved socket system comprising in combination:

a rotor having two opposing planar faces and two opposing faces each of which contain facing v-shaped recesses, the socket thus being dimensioned to receive a wide variety of stem geometries;

a polygonal stem adapted to be removably inserted within the rotor, the stem including a plurality of planar faces, a spring biased ball position within a lower corner of one of the faces, the position of the ball preventing engagement with one of the v-shaped recesses.

2. An improved socket system comprising in combination:

a rotor having two opposing faces each of which contain v-shaped recesses, the rotor thus being dimensioned to receive a wide variety of socket stem geometries;

a polygonal stem adapted to be removably inserted within the socket, the stem including a plurality of planar faces, a spring biased ball positioned off center within a lower corner of one of the faces, the position of the ball preventing engagement with one of the v-shaped recesses.

3. The system as described in claim 2 wherein the stem has six planar faces.

4. The system as described in claim 2 wherein the stem has four planar faces.

5. The system as described in claim 2 wherein the stem has a drill element secured to an upper extent of the stem.

6. The system as described in claim 2 wherein the stem as a female socket formed at an upper extent of the stem.

7. A versatile driving element for use in conjunction with a ratchet wrench, the driving element comprising in combination:

a stem section having a plurality of planar faces;

a driving element secured integral with one end of the stem section, the driving element taking the form of a phillips head screw driver;

an elastic o-ring positioned within a groove formed along the length of the driving element to accept other sockets;

a female socket having a first end with a recess formed therein, the recess adapted to accommodate fasteners of various sizes and a second end with a recess formed therein, the recess of the second end adapted to be removably positioned over the driving element and its associated o-ring.

* * * * *